United States Patent [19]

Colvin

[11] 4,368,884

[45] Jan. 18, 1983

[54] SAFETY BENCH PRESSING APPARATUS

[76] Inventor: Randy G. Colvin, 8100 Sands Point, Apt. 1906, Houston, Tex. 77036

[21] Appl. No.: 228,720

[22] Filed: Jan. 27, 1981

[51] Int. Cl.[3] ..... A63B 13/00

[52] U.S. Cl. ..... 272/123; 272/DIG. 4

[58] Field of Search ..... 272/123, 122, 117, 116, 272/144, 134, 93

[56] References Cited

U.S. PATENT DOCUMENTS 4,205,838 6/1980 McIntosh ..... 272/123

4,249,726 2/1981 Faust ..... 272/117

OTHER PUBLICATIONS

"New Mark VI"—Marcy Catalogue; p. 47, 1974.

*Primary Examiner*—Richard C. Pinkham

*Assistant Examiner*—William R. Browne

*Attorney, Agent, or Firm*—John T. Roberts

[57] ABSTRACT

A safety bench pressing apparatus is disclosed which prevents injury from the droppage of barbells. The apparatus includes a three sided frame which functions to catch barbells that are dropped during bench pressing by a person reclining on a standard bench pressing bench. The three sides of the frame include a horizontal member and first and second vertical sections which are respectively joined to the ends of the horizontal member. Each vertical section contains a horizontal support which is vertically positioned above the bench. The horizontal supports catch any barbells which are dropped above the head, neck and chest cavity of a person reclining on the bench during bench pressing. The horizontal members are adjustable in height.

8 Claims, 4 Drawing Figures

SAFETY BENCH PRESSING APPARATUS

BACKGROUND OF THE INVENTION

1. Field of the Invention

The invention relates to apparatus for preventing accidents caused by the droppage of barbells during bench pressing.

2. Description of the Prior Art

The bench press has been one of the standard weight training exercises for many years. Over the years there have been numerous serious injuries to persons who are engaged in bench pressing as a consequence of the droppage of a barbell on the face, neck and chest cavity.

U.S. Pat. No. 4,205,838 discloses safety stands for use in protecting persons from injury by the droppage of barbells during bench pressing. The patent does not disclose that the width of the stands should be sufficient to prevent injury to at least the face, neck, and chest cavity of the lifter. Moreover, the individual stands are not rigidly attached to a frame as in the present invention which decreases their stability. With the safety stands of that patent where the lifter has a loss of control, it would be possible to have the barbell far enough out of position with respect to the upturned ends to tip the stands thereby causing injury.

SUMMARY OF THE INVENTION

The invention is a safety bench pressing apparatus which prevents injuries as a consequence of the droppage of barbells. The invention has a three sided frame which is comprised of first and second vertical sections that are disposed parallel to a standard bench pressing stand and a horizontal member which is joined at its ends to the first and second vertical sections. The first and second vertical sections each contain a horizontal support which is disposed parallel to and above the bench. The horizontal supports function as a barbell support to prevent droppage of barbells onto at least the face, neck and chest cavity during bench pressing. The standard bench may be rigidly secured to the three sided frame by additional members.

DESCRIPTION OF THE PREFERRED EMBODIMENTS

Figure 1:
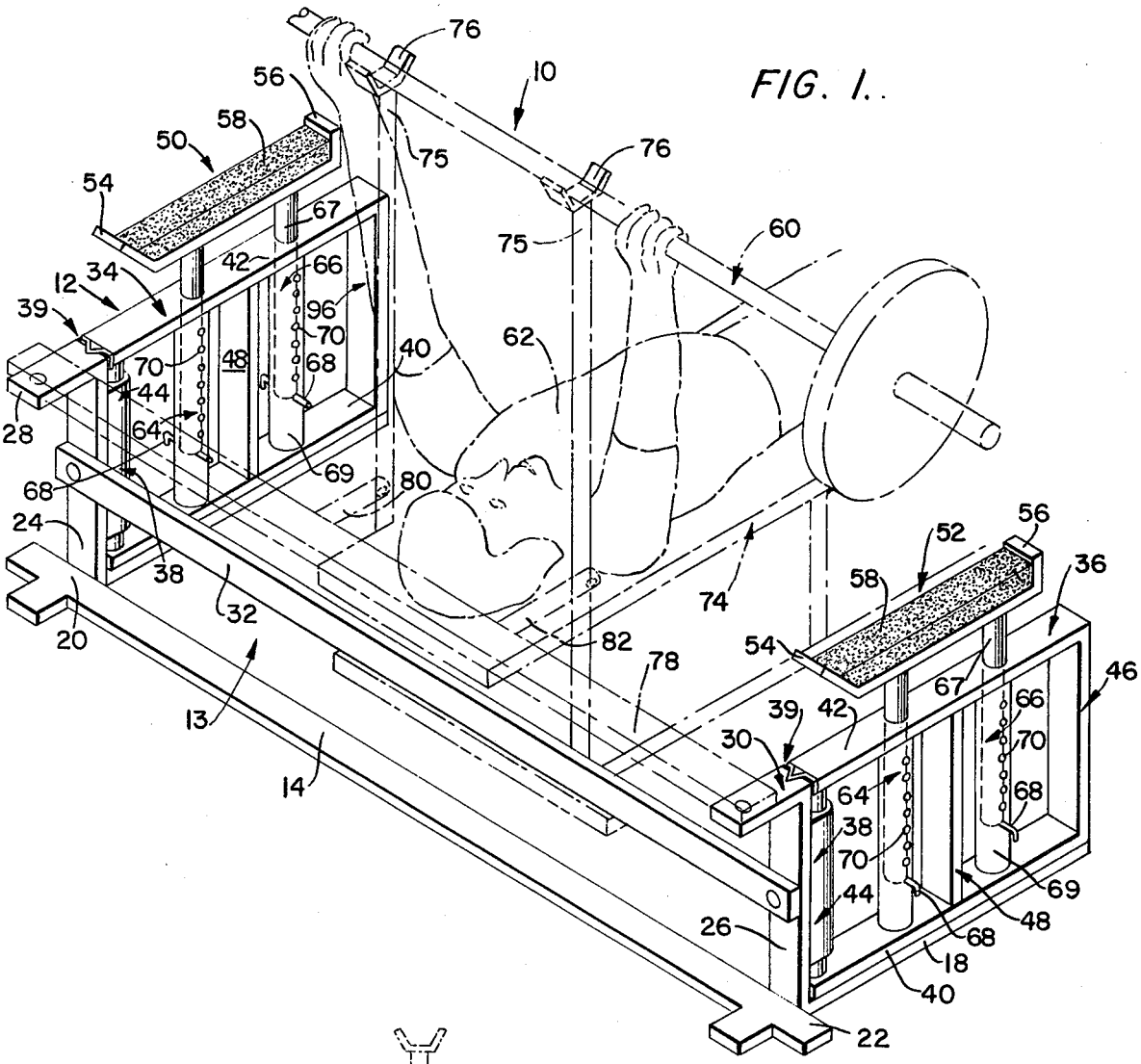
FIG. 1 is a perspective view of a safety bench pressing apparatus in accordance with the invention.
Figure 2:
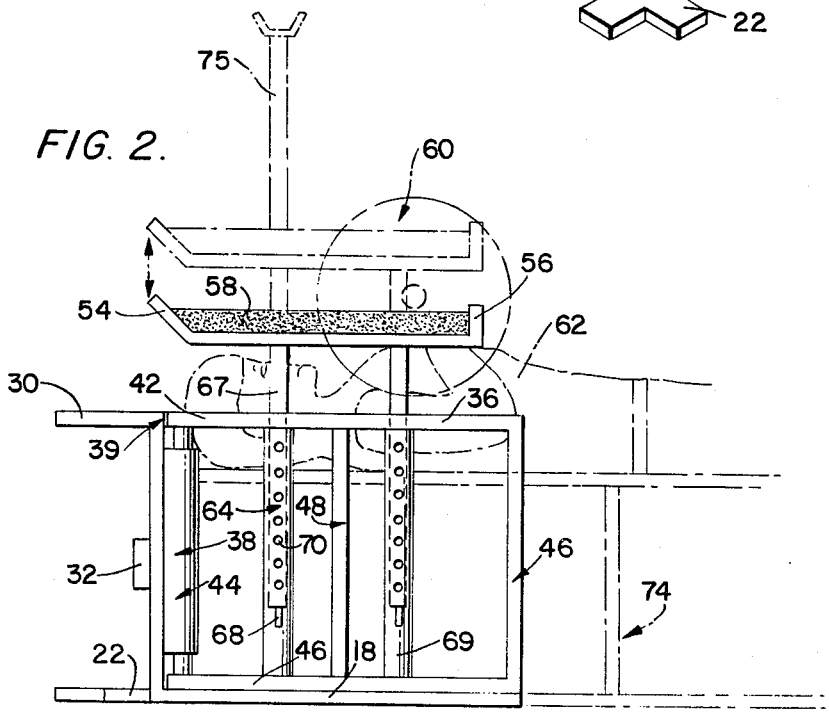
FIG. 2 is a side view of the apparatus of FIG. 1.
Figure 3:
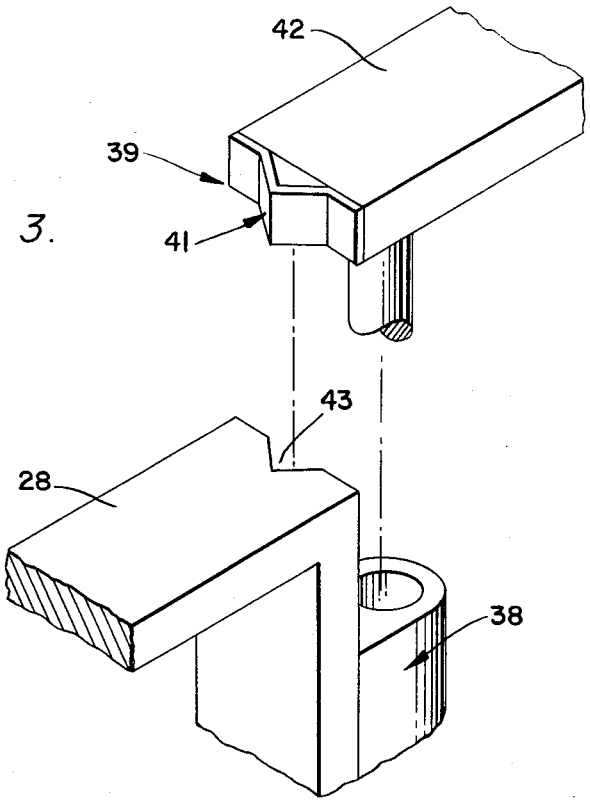
FIG. 3 is a view of a safety slot and catch which permits selective positioning of the first and second vertical sections in an extended or folded orientation.
Figure 4:
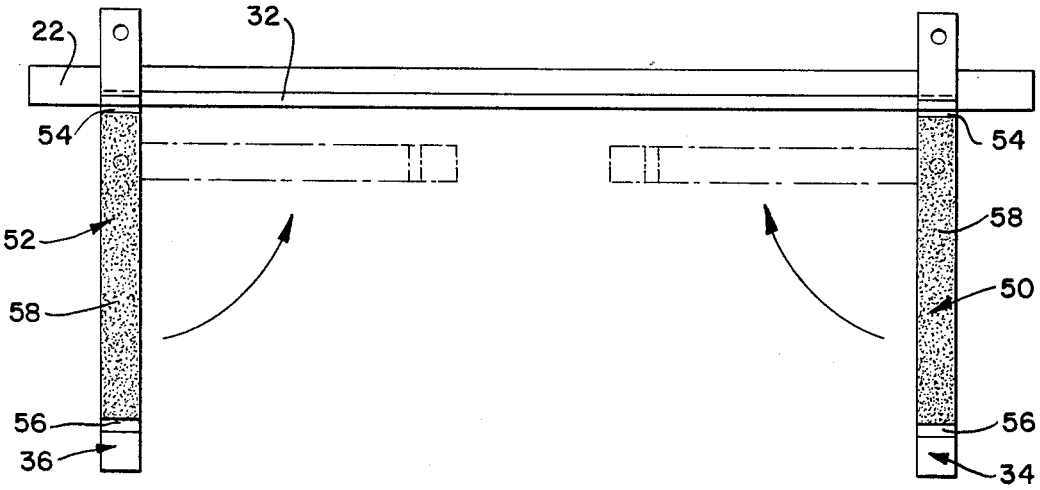
FIG. 4 is a top view of the apparatus of FIG. 1.

FIGS. 1–4 illustrate a safety bench pressing apparatus 10 in accordance with the present invention. The invention 10 has a three sided rigid frame 12. The first side 13 of the frame 12 is comprised of a first horizontal member 14 and a second elevated horizontal member 32. The remaining two sides are comprised of first and second vertical sections 34 and 36 which include two orthogonal projecting members 16 and 18 respectively attached to the first horizontal member in proximity to ends 20 and 22. The horizontal member 14 and orthogonal members 16 and 18 function to provide a stable tip resistant base for supporting the pivoted vertical sections 34 and 36 which are described infra. The first and second vertical sections 34 and 36 include vertical members 24 and 26 which are respectively joined to the orthogonal projecting members 16 and 18. Horizontal sections 28 and 30 respectively are joined to the top of vertical members 24 and 26. The second horizontal member 32 is joined to the vertical members 24 and 26 to provide horizontal rigidity to the vertical members and associated vertical sections 34 and 36. Vertical sections 34 and 36 are pivotably joined to vertical members 24 and 26 by any suitable type of pivotable connection 38 such as a hinge. FIG. 3 illustrates a detent mechanism 39 which is part of each hinge 38. The detent mechanisms 39 function to lock the first and second vertical sections 34 and 36 in a position which is orthogonal to the first side 13 as illustrated in FIG. 1. Each detent mechanism 39 is comprised of a V-shaped projection 41 which may be a rigid piece of metal and a corresponding V shaped cutout 43 in the horizontal sections 28 and 30. The vertical sections 34 and 36 may be pivoted by lifting them up to a vertical position where the V shaped projection 41 clears the V shaped cutout 43. The pivotable connection 38 of each vertical section 34 and 36 functions to permit the folding back of the vertical sections parallel to side 13 for storage as illustrated in phantom in FIG. 4 and the folding out into an orthogonal position as illustrated in FIG. 1 for use during bench pressing. Each vertical section 34 and 36 has a bottom side 40 and a top side 42 which are joined by two end cross members 44 and 46 and a center cross member 48. The side member 44 includes the pivotable connection 38. A pair of horizontal barbell supports 50 and 52 are respectively mounted within the vertical sections 34 and 36 and are parallel to the longitudinal dimension of the vertical sections. Each horizontal support 50 and 52 has a barbell retaining means which is a pair of turned up ends 54 and 56. A foam rubber pad 58, or other similar compressible material, is located between the turned up ends 54 and 56 on top of each horizontal support 50 and 52. The compressability of the pad 58 functions to retain a barbell 60 in the longitudinal position along the horizontal supports 50 and 52 at which it was released by a lifter 62 after the completion of the last bench press. Each horizontal support 50 and 52 may be positioned in any one of a plurality of fixed vertical positions by the adjustment of the length of a pair of vertical telescoping members 64 and 66, which have an upper part 67 that is joined to each horizontal support and a lower part 69 that is joined to each vertical section 34 and 36 and the placement of retaining pins 68 in an appropriate hole 70 to cause the retaining pin to support the lowermost extension of the upper part 67 of the telescoping member. A standard bench pressing bench 74 is positioned parallel to and midway between the vertical sections 34 and 36 to permit a lifter to horizontally recline in a bench pressing position such that the head is located in proximity to the horizontal members 14 and 32 of the first side 13. The standard bench pressing bench 74 has a pair of vertical projections 75 which have forks 76 or other barbell retaining means located at their highest vertical point. The forks 76 are at a vertical position at which the barbell 60 is located prior to starting bench pressing. As will be explained infra, the forks 76 are normally at a vertical position which is higher than the vertical position of the horizontal supports 50 and 52. When the forks 76 are higher than the horizontal supports 50 and 52, the horizontal supports do not function to retain the barbell 60 in an elevated position unless a lifter has lost control of the barbell or was not able to lift the barbell back into the forks 76.

The position of each horizontal section 50 and 52 with respect to associated vertical sections 34 and 36 and its length is an important part of the present invention. The horizontal supports 50 and 52 should be of a length equal to or greater than the distance spanned by the head, neck and chest cavity of a lifter reclining on bench 74 during bench pressing. Specifically, the horizontal supports 50 and 52 should be retained in the vertical sections 34 and 36 at a position along the longitudinal dimension of vertical sections such that one end of each horizontal support which is closest to the upturned end 54 is positioned directly above the position where a lifter's head is located during bench pressing and the other end of each horizontal support which is closest to the upturned end 56 is positioned directly above the position where a lifter's chest cavity is positioned or portion of the body below the chest cavity is located during bench pressing.

FIG. 1 illustrates in phantom a modification of the safety bench pressing apparatus in which the standard bench pressing bench 74 is rigidly attached to the three sided frame 12 by means of a lateral brace 78 which is bolted to the horizontal sections 28 and 30 and two longitudinal braces 80 and 82 which at one end are bolted to the vertical projection 75 of the standard bench 74 and to the lateral brace at the other end. The advantage of the modification is that the braces 78, 80 and 82 precisely and rigidly locate the bench 74 with respect to the three sided frame 12 thereby making it impossible to improperly position or tip the bench. It should be understood that the modification of FIG. 1 is not limited to any particular arrangement for attaching the bench 74 to the three sided frame.

The invention is used as follows. In the case of the embodiment of FIG. 1 which is not rigidly secured to the standard bench 74, the standard bench is positioned midway between the vertical sections 34 and 36 with the longitudinal dimension of the bench being parallel to the vertical sections as illustrated in FIG. 1. The end of the bench 74 which is closest to the vertical projections 75 is positioned in proximity to the side 13. The vertical height of the horizontal supports 50 and 52 is adjusted so that they are just below the lowest point that a barbell is lowered to during normal bench pressing by the person 62 who is to use the safety bench pressing apparatus 10. The vertical height at which the horizontal supports 50 and 52 are set must be above the height of the lifter's face and chest cavity to ensure that a dropped barbell will not cause personal injury. The lifter 62 then proceeds to the bench pressing position on bench 74 as illustrated in FIG. 1 and lifts the barbell 60 from the forks 76 and attempts to perform whatever exercise routine which is desired. Any injury from the loss of control or droppage of the barbell 60 is prevented by the fact that the barbell must come to rest at position on the horizontal supports 50 and 52 which is above the face and chest cavity. Without the present invention, if control of the barbell 60 was lost or if it was dropped, which normally occurs below the vertical position of the forks 76, the lifter 62 would potentially incur serious injury. The modification of FIG. 1 which includes braces 78, 80 and 82, is used in the same manner as the embodiment of FIG. 1. The only difference in set up between the two embodiments of the invention is that the bench 74 is held in a tip resistant fixed position by the braces 78, 80 and 82 which rigidly attach the bench to the three sided frame 12 and eliminates the need for positioning the bench with respect to the three sided frame.

While the invention has been described in terms of two embodiments, it should be understood that numerous modifications may be made thereto without departing from the spirit and scope of the invention as defined by the appended claims. For example, the length of the horizontal supports 50 and 52 may be increased to protect more of the body and the sides of the frame 13 may be modified to contain additional or different structural members.

I claim:

1. A safety bench pressing apparatus comprising:

(a) a horizontal bench extending longitudinally in a first direction;

(b) a three sided frame, the first side having a first horizontally disposed member having first and second ends, the second and third sides respectively having first and second vertically extending sections, the first vertically extending section being joined to the first horizontally disposed member at a position in proximity to the first end and the second vertically extending section being joined to the first horizontally disposed member at a position in proximity to the second end, the first and second vertically extending sections projecting from the horizontally disposed member in a direction parallel to the bench in the first direction, the bench being located between the first and second vertically extending sections;

(c) means for connecting the frame to the bench to form a unitary structure;

(d) a first horizontal support mounted in the first vertically extending section which extends parallel to the first vertical section and a second horizontal support mounted in the second vertically extending section which extends parallel to the second vertical section, each horizontal support having first and second ends and having a length which is equal to or greater than the distance between the face, neck and chest cavity of a person who is horizontally disposed on the exercising bench which is disposed between the first and second sections and being positioned with respect to the first and second vertical sections such that one end of each horizontal support is directly above the face of the lifter and the other end is directly above the chest cavity or a part of the body below the chest cavity; and (e) means for retaining a barbell associated with each horizontal support to prevent a barbell from rolling off of each horizontal support.

2. The apparatus of claim 1 further comprising a pair of vertical members joined to the bench at a position in proximity to the first side, the vertically extending members extending above the bench for supporting a barbell at a position above the bench.

3. The apparatus of claim 2 further comprising first and second orthogonal members, the first member being joined to the first horizontal member at a position in proximity to the juncture of the first vertical section to the first horizontal member at a position below the first vertical section and the second member being joined to the first horizontal member at a position in proximity to the juncture of the second vertical section to the first horizontal member at a position below the second vertical section.

4. The apparatus of claim 3 further comprising means for pivoting each of the first and second sections with respect to the first horizontally disposed member to permit the first and second vertically extending sections to pivot to a position wherein they are parallel to the first horizontally disposed member for purposes of storage and to pivot to a position where they are orthogonal to the horizontally disposed member during use of the exercise bench.

5. The apparatus of claim 4 further comprising means for adjusting the vertical height of the first and second horizontal supports to permit adjustment of the height at which a barbell is supported by the first and second horizontal supports.

6. The apparatus of claim 5 wherein the means for adjusting the vertical height of each horizontal support comprises a pair of telescoping members which may be adjusted to a plurality of different heights, each telescoping member having an upper part which is joined to the horizontal support and a lower part which is joined to the vertical section with which the horizontal support is associated.

7. The apparatus of claim 6 further comprising (a) a first vertical member joined to the first orthogonal member at a position adjacent to the point of attachment of the first orthogonal member to the first horizontal member;

(b) a second vertical member joined to the second orthogonal member at a position adjacent to the point of attachment of the second orthogonal member to the first horizontal member; and (c) a second horizontally disposed member having first and second ends which are respectively joined to the first and second vertical sections at a position vertically above the first horizontal member.

8. The apparatus of claim 4 further comprising, a pivot means for pivoting each of the sections, a detent mechanism associated with each of the pivot means for locking the first and second sections in a position orthogonal to the first side.

* * * * *